United States Patent [19]

Ippolito et al.

[11] Patent Number: 4,535,853

[45] Date of Patent: Aug. 20, 1985

[54] DRILL BIT FOR JET ASSISTED ROTARY DRILLING

[75] Inventors: Serge Ippolito, Freyming-Merlebach; Georges A. Cagnioncle, Mulhouse, both of France

[73] Assignees: Charbonnages de France, Paris; Cocentall - Ateliers de Carspach, Mulhouse, both of France

[21] Appl. No.: 564,804

[22] Filed: Dec. 23, 1983

[30] Foreign Application Priority Data

Dec. 23, 1982 [FR] France ..... 82 21674

[51] Int. Cl.[3] ..... E21B 10/02

[52] U.S. Cl. ..... 175/404; 175/393; 175/418; 175/410

[58] Field of Search ..... 175/393, 404, 65, 398, 175/410, 421, 418, 401; 299/17

[56] References Cited

U.S. PATENT DOCUMENTS

| | | | |
|---|---|---|---|
| 2,024,730 | 12/1935 | Hammer | 175/333 |
| 2,494,188 | 1/1950 | Meaney | 175/410 X |
| 2,740,612 | 4/1956 | Phipps | 175/393 |
| 2,854,219 | 9/1958 | MacNeil | 175/404 |
| 2,857,140 | 10/1958 | Johnson | 175/393 |
| 2,905,443 | 9/1959 | Goett | 175/418 |
| 3,077,936 | 2/1963 | Arvtonoff | 175/404 X |
| 3,301,339 | 1/1967 | Pennebaker, Jr. | 175/387 |
| 3,672,455 | 6/1972 | Foster | 175/418 X |
| 4,207,954 | 6/1980 | Jerome | 175/404 X |

FOREIGN PATENT DOCUMENTS

| | | |
|---|---|---|
| 659574 | 3/1963 | Canada . |
| 151171 | 6/1903 | Fed. Rep. of Germany . |
| 2555672 | 6/1977 | Fed. Rep. of Germany . |
| 2735855 | 2/1978 | Fed. Rep. of Germany . |
| 1002187 | 3/1952 | France . |
| 1176596 | 4/1959 | France . |
| 1411867 | 8/1963 | France . |
| 1463719 | 1/1965 | France . |
| 2135053 | 12/1972 | France . |
| WO80/0285 | 8/1980 | PCT Int'l Appl. . |

*Primary Examiner*—Stephen J. Novosad
*Assistant Examiner*—Thuy M. Bui
*Attorney, Agent, or Firm*—Karl W. Flocks; Sheridan Neimark

[57] ABSTRACT

The invention relates to the geometry of drill bits for jet assisted rotary drilling. According to the invention there is used a drill bit comprising platelets of small radial dimension disposed about a central burster in a discontinuous peripheral crown axially extending said drill bit, channels for supplying pressurized fluid opening from the crown close to the platelets. Said platelets are preferably separated from one another by rectilinear discharge ramps. A drill bit in accordance with this invention can be manufactured e.g. by turning or milling. It can be applied for drilling rock formations in mines, and other hard materials.

20 Claims, 4 Drawing Figures

DRILL BIT FOR JET ASSISTED ROTARY DRILLING

BACKGROUND OF THE INVENTION

This invention relates to drill bits for jet assisted rotary drilling and its object is more particularly related to the optimization of the geometry of drill bils.

As known, a drill bit is a mining tool which is mounted at the end of a drill pipe driven into rotation and which is used for biting in and penetrating rocks parallel to its rotary axis by means of sharp edges formed on its working face. Such sharp edges generally consist of plates of high hardness most often made of tungsten carbide and built up by brazing; it is then specified sometimes that the drill bit has built up inserts.

Such drill bits are used in practice for drilling into relatively soft and little abrasive rocks. For harder and/or more abrasive rocks it has been proposed to utilize rotary percussion drilling with impacting effect but such drilling appears to have serious disadvantages in as much as, apart from resulting in very high installation costs, it gives rise to noises, vibrations, and oil vapours, very detrimental to the ergonomical rules, or even to security.

Another solution, which appears to have great future, i.e. jet assisted rotary drilling, has however been proposed recently for drilling semi-hard rocks (pressures higher than or equal to about 800 bars), and hard and abrasive rocks.

This method consists in driving a drill bit into simple rotation without impacting effect, while injecting close to its sharp cutting edges a very high pressure fluid which fractures rocks and thereby facilitates cutting down thereof by the drill bit.

The utilization of such method gave rise to certain difficulties related to supplying said fluid under very high pressure, most often water, through the drill pipe and the drill bit. It is however to be noted that it was already known to feed water or air at low pressure (about 20 to 40 bars) to the drill bit for moving away drilling or cutting debris.

French patent No. 2 450 936 (G.CAGNIONCLE) filed on Mar. 8, 1979 describes a method for getting over such difficulties. For utilizing the method described therein it is contemplated to form through a drill bit two sets of pressurized fluid channels i.e. low pressure fluid inlet channels for removal of debris, and much narrower channels for feeding fluid under very high pressure (1000 to 4000 bars), for assisting the drilling proper, opening through or forwardly of the built up inserts. This patent also describes the whole liquid supply device required for fluid injection under two very different pressures.

It appears actually that the drill bits employed heretofore for purposes other than assisted rotary drilling have a geometry very close to that of the conventional drill bits (without jet assistance).

SUMMARY OF THE INVENTION

The applicant has now found in the course of its research work that jet assistance in rotary drilling allows for a completely new design of the drill bits to be used.

The object of this invention is therefore a new drill bit geometry capable of providing higher performances than those of the drill bits known at present, with a lesser manufacturing cost.

To this end, it is proposed in accordance with this invention, a mining drill bit for jet assisted rotary drilling to be mounted to the end of a rotary drive rod and of the type comprising, opposite to said rod, a plurality of drilling inserts formed with radially and axially projecting working edges angularly separated from one another by debris removal ramps, in combination with very high pressure fluid supply channels opening close to said inserts, said drill bits being characterized in that the inserts are of a small radial dimension and are inserted about a central burster in a discontinuous peripheral crown axially extending said drill bit, said fluid supply channels passing through said crown.

Such drill bit geometry very clearly differs from geometries known at present. As a matter of fact, prior art drill bits are generally compact and massive; they comprise inserts having a radial dimension slightly lower than the largest radius of the drill bit so as to drill rocks over practically all the cross-section of the drill bit. Due to their size such inserts are submitted during rotation to high stresses which they cannot resist unless they are in a resting position on a large metallic mass. Practically, such inserts are supported by helical arms produced by forging or they are clamped in notches formed in a massive drill bit such as shown in the mentioned French patent No. 2 450 936.

On the other hand, the drill bit according to this invention turns out to lead to the utilization of smaller inserts adapted to exert, through their axially projecting edges and for the same axial thrust, much higher penetration forces than in the prior art when the axial thrust was distributed over much longer radial edges. Therefore, a drill bit in accordance with this invention can drill much harder rocks than heretofore, since it may develop pressures of 600–800 bars and more. It is to be noted that, due to the presence of a central burster which may for example be a cone, preferably in precession, or a pressurized fluid jet, any risk of drill bit bumping against a central rock zone not cut down by the inserts can be avoided.

According to an important characteristic of this invention, the debris discharge ramps are rectilinear. This causes greatly decreased manufacturing costs in as much as the invention proposes such a drill bit which can be formed, before inserts brazing, in simple and little expensive working steps such as turning or milling.

BRIEF DESCRIPTION OF THE DRAWINGS

Other objects, characteristics and advantages of this invention will appear from the following description given by way of non limitative examples with reference to the attached drawings, in which.

DETAILED DESCRIPTION OF THE PREFERRED EMBODIMENT

Figure 1:
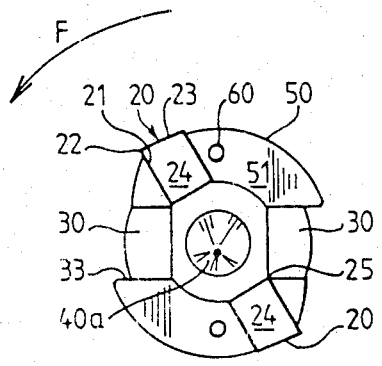
FIG. 1 is a front view of a first form of embodiment of the drill bit according to the invention.
Figure 2:
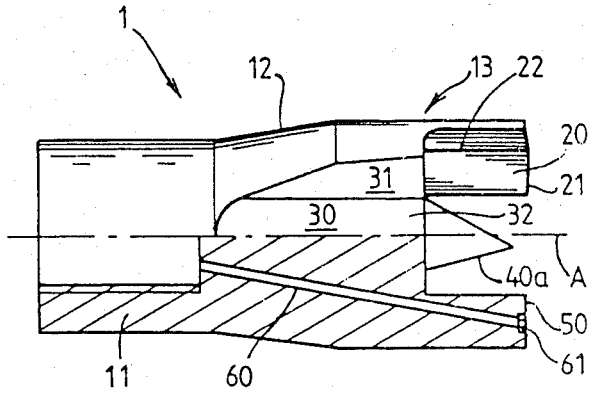
FIG. 2 is a lateral view of the drill bit of FIG. 1 with partial section therethrough on one side of the centerline.
Figure 3:
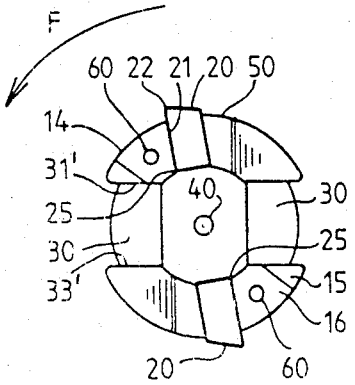
FIG. 3 is a front view of a second form of embodiment of a drill bit according to the invention.
Figure 4:
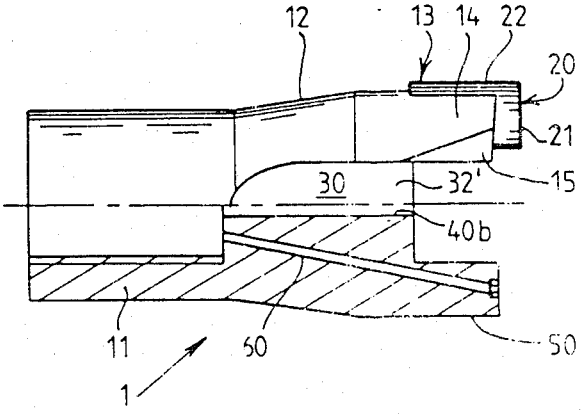
FIG. 4 is a side view of the drill bit of FIG. 3, with partial section therethrough on one side of the centerline.

As shown by way of example in FIGS. 1 and 2, or in FIGS. 3 and 4, a drill bit 1 according to the invention, which advantageously is axially symmetrical, comprises in a known manner at one end a securing skirt 11 inwardly threaded for receiving the extremity of a drilling pipe or rod not shown for driving into rotation the drill bit 1 during the drilling operation.

The drill bit 1 widens from skirt 11 to a connecting section 12 to terminate into a working end 13 which is the body of the drill bit. In the examples of embodiment shown, the securement skirt 11 and the body 13 are cylindric whereas the connecting section is frusto-conical.

In a known manner, the drill bit body 13 carries a plurality of inserts 20, two inserts for each drill bit in the example shown, advantageously angularly distributed in a regular manner so as to distribute appropriately forces within the drill bit. Such inserts have axially and radially projecting working edges 21 and 22.

The inserts are built up in a known manner by brazing and separated angularly by ramps 30 for removal of rock breaking debris.

In accordance with this invention, the inserts are of a small radial dimension in the order of half the radius of the body 13 in the form of embodiment represented. They are inserted about a central burster 40 in a discontinuous peripheral crown 50 axially extending from the drill bit 1. Channels 60 for supplying pressurized fluid, generally water, extend through the discontinuous crown 50 and open close to the edges 21; they are preferably rectilinear; at their other end they open within the skirt 11 where they are fed with liquid through the rotational drive rod (not shown) by a device of any known type.

Several drill bit configurations are possible depending on whether channels 60, in view of the direction of rotation of the drill bits as shown by arrow F, open in front of edges 21, across the plates 20 or rearwardly thereof. To prevent any difficulty of alignment on brazing the inserts, it is proposed according to the invention to form the channels 60 preferably outside of inserts 20.

It is to be noted that for clarity of the drawings, the diameter of channels 60 is clearly oversized in FIGS. 2 and 4 as compared to the actual ones. Practically, such channels are designed to provide, adjacent to the inserts, for injection of high pressure fluid with a pressure that may reach 1000 bars and more, higher than pressures used heretofore. Calibration of the so injected fluid jets, and also orientation thereof is preferably provided by injection nozzles 61 only shown in FIGS. 2 and 4.

FIGS. 1 and 2 illustrate a drill bit according to the invention in which the fluid injection channels 60 open rearwardly of the associated inserts 20.

Such inserts 20 are of a radial thickness roughly equal to that of crown 50. Their cross-section is trapezoidal such that their outer lateral face 23 is radially recessed in respect to edge 22 and does not engage rocks or the material to be drilled in. Similarly, the outer front face 24 of each insert is inclined from the rotary axis A of the drill bit. Preferably, the transverse surface 51 of crown 50 rearwardly of the inserts is also inclined rearwardly so as to keep the opening of channels 60 axially recessed in respect to the rock drilling face. In this way the edges only of the inserts participate in the drilling.

The discontinuous crown 50 deviates from the rocks to be drilled in thereby to provide connection with a discharge ramp 30, after such a transverse zone 51 into which at least one pressurized fluid supply channel opens.

As appears from FIGS. 1 and 2, such a ramp 30 is advantageously delimited by rectilinear surfaces 31, 32, 33 which may be easily produced by milling. The discharge ramps 30 are continued up to the height of the securement skirt such that debris can then be discharged between the walls of the drilled bore and the skirt 11, and thereafter the rotational drive rod.

The surface 31 in each withdrawal ramp preferably ends up at the base of the following inserts so as to facilitate discharge of rock debris running along the forward face of said insert from the edge 21.

In the shown example of embodiment the crown 50 surrounds a central burster 40 consisting of a cone **40*a*** pointing to the rocks to be drilled in. For easy manufacturing, such cone is preferably added on. Moreover, its centerline is advantageously inclined from the rotational axis A so as to be submitted to a slight precessional motion in rotation, thereby increasing efficiency thereof.

On the other hand, FIGS. 3 and 4 illustrate a drill bit in accordance with this invention, in which the injection channels 60 open forwardly of inserts 20; such plates have a configuration very similar to that of the inserts in FIGS. 1 and 2. In view of the fact that the fluid jets are the more efficient for fracturing the rocks as they are coherent, such jets preferably open adjacent to the rocks to be drilled in. Consequently, the body 13 of the drill bit comprises a shoulder 14 extending up axially towards the rocks in front of each plate; the inserts are thus built up in notches formed axially in body 13. The front surface 16 of shoulders 14 into which channels 60 open is advantageously inclined to the centerline to provide for easy discharge of the debris towards the ramps. Such discharge is moreover facilitated due to a connection surface 15, between the front surface 16 and the rectilinear surfaces 31' of said ramp 30, which as in the preceding example of embodiment is preferably delimited by rectilinear surfaces 31', 32', 33'.

In the example shown in FIGS. 3 and 4, the central burster 40 consists of a pressurized fluid supply pipe **40*b* for bursting apart a portion of rocks which is not already cut down by the inserts although it was already weakened and fractured thereby. Such channel 40*b* is preferably fed from the same source of pressure as channels 60** so as to simplify the structure of the rotational drive rod which is to be used.

It is to be noted that in both examples shown the inserts 20 are disposed radially across the crowns 50 such that edges 21 themselves are not radial and the inserts therefore present a drilling wedge 25 which is taken over during the drilling successively by edges 21 and then 22. The drilling capacities of the inserts are thus optimized.

It will be understood that many modified forms of embodiment can be proposed by the man of the art, without however departing from the scope of the invention as defined by the attached claims. Thus, the number of inserts, the position and number of pressurized fluid injection channels, the direction thereof, the inclinations of the various faces of the insert, of the crown or of the ramps, or else, the structure of the central burster may be selected depending on the individual requirements of each user and of the particular material to be drilled in.

We claim:

1. A rock drill bit for very high pressure jet assisted rotary drilling to be mounted to the end of a rotational drive rod for rotation around a rotational axis, comprising a body, a discontinuous peripheral crown axially extending from said body opposite to said rod, a central burster within said crown, at least two drilling plates inserted in said crown, having a small radial dimension and formed with working edges radially and axially projecting from said crown, said drilling plates being circumferentially separated by debris discharge ramps provided across said crown, and very high pressure fluid supply channels crossing through said crown and opening close to said plates.

2. A drill bit according to claim 1, wherein said discharge ramps are limited by rectilinear faces.

3. A drill bit according to claim 1, which has an axial symmetry with respect to said rotational axis.

4. A drill bit according to claim 1, wherein said central burster is a cone.

5. A drill bit according to claim 4, wherein said cone is inclined with respect to said rotational axis.

6. A drill bit according to claim 5, wherein said cone is attached to said body.

7. A drill bit according to claim 1, wherein said central burster is constituted by a very high pressure fluid supply channel.

8. A drill bit according to claim 7, wherein all very high pressure fluid supply channels are supplied from a same source of pressure.

9. A drill bit according to claim 1, wherein said inserts are formed with a drilling wedge.

10. A drill bit according to claim 1, wherein said very high pressure fluid supply channels open forwardly of the inserts through shoulders extending up towards the material to be drilled along said inserts.

11. A rock drill bit for very high pressure jet assisted rotary drilling to be mounted to the end of a rotational drive rod for rotation around a rotational axis, comprising a body, a discontinuous peripheral crown axially extending from said body opposite to said rod, a central burster within said crown, at least two drilling plates inserted in said crown, having a small radial dimension and formed with working edges radially and axially projecting from said crown, said drilling plates being circumferentially separated by debris discharge ramps provided across said crown, and very high pressure fluid supply channels crossing through said crown and opening close to said plates, said discharge ramps being limited by rectilinear faces and said central burster being a cone which is inclined with respect to said rotational axis.

12. The drill bit of claim 11, wherein said drill bit has axial symmetry with respect to said rotational axis.

13. The drill bit of claim 12, wherein said cone is attached to said body.

14. The drill bit of claim 13, wherein all very high pressure fluid supply channels are supplied from a common source of pressure.

15. The drill bit of claim 14, wherein said plates are formed with a drilling wedge.

16. The drill bit of claim 15, wherein said very high pressure fluid supply channels open forwardly of the plates through the shoulders extending upwardly towards the material to be drilled along said plates.

17. A rock drill bit for very high pressure jet assisted rotary drilling to be mounted to the end of a rotational drive rod for rotation around a rotational axis, comprising a body, a discontinuous peripheral crown axially extending from said body opposite to said rod, a central burster within said crown, at least two drilling plates inserted in said crown, having a small radial dimension and formed with working edges radially and axially projecting from said crown, said drilling plates being circumferentially separated by debris discharge ramps provided across said crown, and very high pressure fluid supply channels crossing through said crown and opening close to said plates, said plates being formed with a drilling wedge and said very high pressure fluid supply channels open forwardly of said plates through shoulder extending up towards the material to be drilled along said plates.

18. The drill bit of claim 17 wherein said drill discharge ramps are limited by rectangular faces.

19. The drill bit of claim 18 wherein said central burster is a cone, said cone being inclined with respect to said rotational axis.

20. The drill bit of claim 19 wherein said central burster comprises a very high pressure fluid supply channel.

* * * * *